United States Patent [19]

Switall et al.

[11] Patent Number: 5,025,722

[45] Date of Patent: Jun. 25, 1991

[54] ADJUSTABLE SPRAY DAMPENING SYSTEM

[75] Inventors: Thomas G. Switall, Wheeling; Robert O. Bloomquist, Mt. Prospect, both of Ill.

[73] Assignee: Ryco Graphic Manufacturing, Inc., Wheeling, Ill.

[21] Appl. No.: 468,115

[22] Filed: Jan. 22, 1990

[51] Int. Cl.[5] ..... B41L 25/06

[52] U.S. Cl. ..... 101/147; 239/568

[58] Field of Search ..... 101/147, 148, 425; 239/566, 568, 207, 587; 118/46, 300, 313, 321, 668, 673

[56] References Cited

U.S. PATENT DOCUMENTS

| | | | |
|---|---|---|---|
| 2,231,694 | 2/1941 | Stevens | 101/147 |
| 3,764,070 | 10/1973 | Glaser | 101/147 |
| 3,924,531 | 12/1975 | Klingler | 101/147 |
| 4,469,024 | 9/1984 | Schwartz et al. | 101/147 |
| 4,480,548 | 11/1984 | Rebel et al. | 118/46 |
| 4,815,375 | 3/1989 | Switall et al. | 101/148 |

FOREIGN PATENT DOCUMENTS

| | | | |
|---|---|---|---|
| 2460021 | 3/1976 | Fed. Rep. of Germany | 101/147 |

*Primary Examiner*—Edgar S. Burr
*Assistant Examiner*—C. A. Bennett
*Attorney, Agent, or Firm*—Lee, Mann, Smith, McWilliams & Sweeney

[57] ABSTRACT

A spray dampening system is disclosed having a number of spray nozzles arranged in laterally spaced relationship, for spraying dampening fluid onto a dampening roll of a printing press in laterally adjacent individual spray patterns which merge on the dampening roll surface in a substantially continuous and laterally extending composite spray pattern. The system, through an arrangement of a plurality of guideway slots on a stationary member and cam slots on a pair of reciprocally movable cam members, moves the spray nozzles simultaneously laterally toward and away from each other and axially toward and away from the dampening roll surface, so that the width of the composite spray pattern may be adjusted while preventing excessive overlapping of the laterally adjacent individual spray patterns.

18 Claims, 5 Drawing Sheets

ADJUSTABLE SPRAY DAMPENING SYSTEM

BACKGROUND OF THE INVENTION

This invention relates to a spray dampening system of a type used for spraying dampening fluid onto the dampening roller or inking roller of an offset printing press, and more particularly the invention relates to a spray dampening system in which the width of the spray pattern may be adjusted while maintaining a uniform delivery of dampening fluid across the width of the dampening roller or inking roller.

In a spray dampening system, the dampening fluid is sprayed onto the press rollers by means of a linear array of spray nozzles with the spray patterns of the individual nozzles merging to form a continuous composite spray pattern across the surface of the press roller. It is important in obtaining proper dampening that the distribution of dampening fluid be as uniform as possible. There should be no starved areas where the amount of dampening fluid is substantially less than the other areas on the surface of the roller, and the overlapping of the adjacent individual spray patterns should be minimized so that there is little or no excessive dampening fluid applied to any portion of the dampening roller.

Various attempts have been made at adjusting the amount of dampening fluid applied to the dampening roll. In U.S. Pat. No. 4,064,801, the valves of the dampening system fluctuate between open and closed positions to regulate the amount of dampening fluid applied to the rolls, and in U.S. Pat. No. 4,649,818, the nozzles are pulsed on and off with the pulse width being adjusted, thereby providing a very precise control over the amount of dampening fluid delivered. In U.S. Pat. No. 4,815,375, there is a delivery of dampening fluid through alternate laterally adjacent nozzles. In U.S. Pat. No. 4,198,907, several independently adjustable needle valves are turned on and off at the same time to control the page dampening, and with proper valving, such as the valves disclosed in U.S. Pat. No. 4,394,873, the nozzle valves can be shut off, or the amount of spray emanating from the nozzle may be regulated. None of the prior art systems, however, allow an adjustment to be made in the width of the dampening pattern, except by shutting off the end nozzles in the nozzle array. However, shutting off the end nozzles only permits an adjustment from a full width pattern to a pattern which is less than a full width by one or two spray nozzle pattern widths. Such systems would not permit an adjustment from say, 60 inches to 50 inches in width.

It of course is possible to move the nozzles toward each other and away from each other in order to narrow the width of the composite spray pattern. However, this would not be satisfactory because as the nozzles are moved toward each other there would be an overlap of the adjacent nozzle spray patterns resulting in overwetting of portions of the dampening roller.

The present invention permits the width of the composite spray pattern to be adjusted to the precise width desired while preventing excessive overlapping of the laterally adjacent individual spray patterns. The result is a system which delivers a uniform composite pattern of spray dampening fluid over a very precise width of the dampening roller.

SUMMARY OF THE INVENTION

The spray dampening system of this invention has a plurality of spray nozzles which are arranged in laterally spaced relationship for spraying a dampening fluid onto a dampening surface, such as the surface of a dampening roll of a printing press. The nozzles spray the dampening fluid onto the dampening roller in laterally adjacent individual spray patterns which merge on the surface of the dampening roller in a substantially continuous and laterally extending composite spray pattern. Means is provided for adjustably moving the spray nozzles laterally toward and away from each other, and axially toward and away from the dampening surface, so that the width of the composite spray pattern may be adjusted while preventing excessive overlapping of the laterally adjacent individual spray patterns. In this movement, the nozzles are preferably maintained in axially parallel relationship, and they preferably remain transversely aligned and uniformly spaced in every position of adjustment. The spray nozzles are selectively moved simultaneously in one direction toward the dampening roller and toward each other, or simultaneously in the opposite direction away from the dampening roller and away from each other. As the nozzles are moved towards each other the composite spray pattern width will be decreased, and by simultaneously moving the nozzles toward the surface of the dampening roller, excessive overlapping of the diverging individual nozzle spray patterns is prevented.

The nozzles are preferably carried on nozzle carriages, each having a follower. There is a stationary member having a plurality of guideways, each for guiding the carriage follower along a pathway between a first position of adjustment closest to the dampening surface, and a second position of adjustment farthest from the dampening surface. A drive means is provided, preferably in the form of a pair of cam members which have cam slots cut therein for accommodating the carriage followers. The cam members are movable relative to the stationary member and to each other for effecting the movement of the followers along the stationary member guideways between the two extreme positions of adjustment. The cam members are preferably movable toward and away from each other by means of a rack formation on each of the cam members and a pinion which is rotatable in meshing engagement with the rack formations. Carriage guide members are horizontally movable relative to one another, and each has a vertical guide track permitting only sliding linear movement of the carriages toward and away from the dampening roller surface perpendicular to the axis of movement of the carriage guide members. Thus the nozzle carriages and the nozzles carried thereon will remain in substantially axially parallel relationship throughout all positions of adjustment and twisting or turning will be prevented.

DETAILED DESCRIPTION OF THE PREFERRED EMBODIMENT

Figure 1:
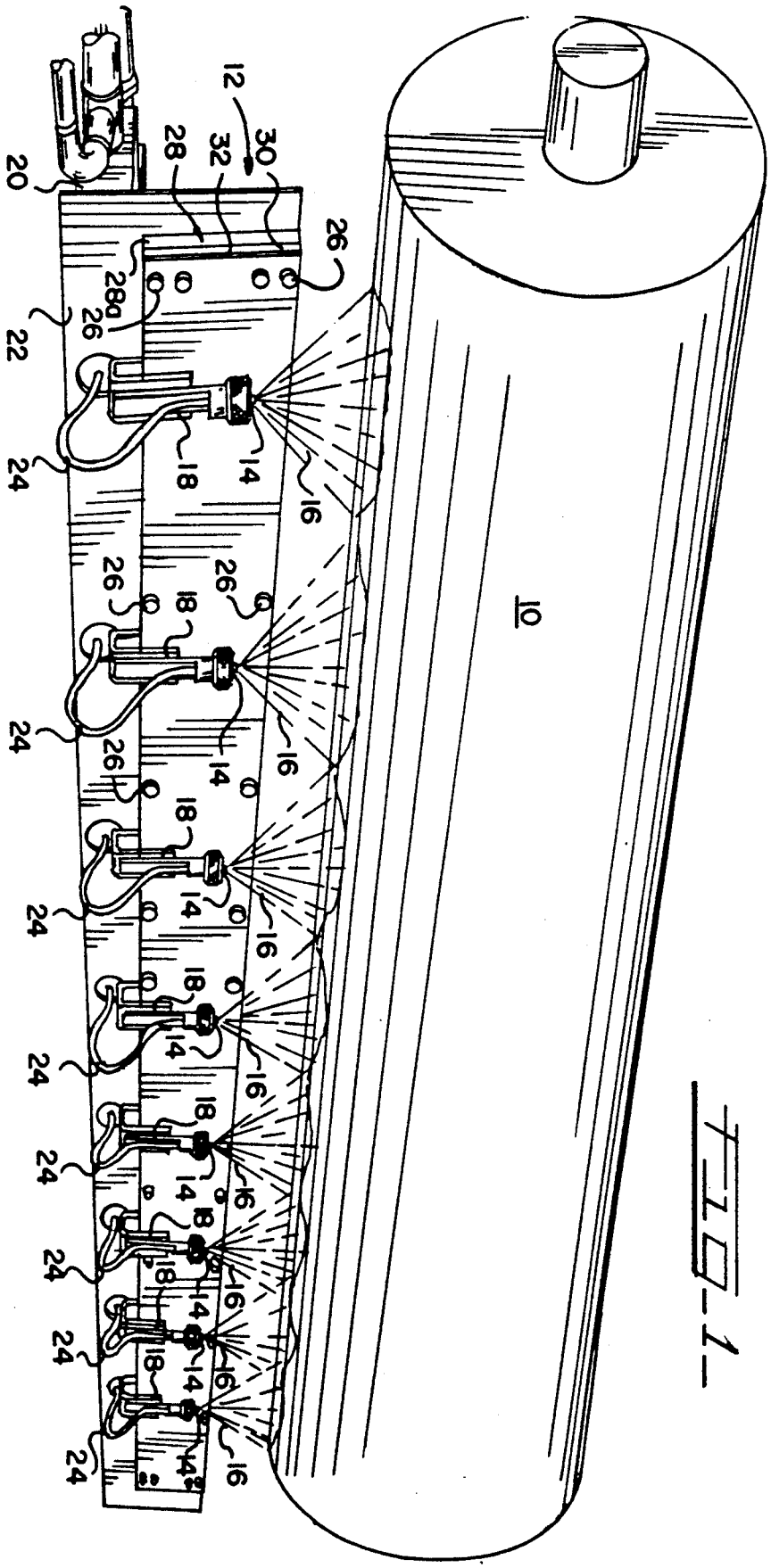
FIG. 1 is a perspective view of an adjustable spray dampening system constructed in accordance with this invention, for spraying dampening fluid onto the dampening roller of an offset printing press.

Referring to FIG. 1, there is shown a dampening roller 10 of a web offset printing press. This dampening roller is adapted to receive dampening fluid delivered by suitable delivery means, such as a spray dampening system 12 constructed in accordance with this invention, and then apply that dampening fluid to a plate cylinder or an inking roller, or both, so that there may be a proper transfer of the inked photoengraved image from the surface of the plate cylinder to the paper, all of which is well known in the art.

The spray dampening system 12 includes a number of spray nozzles 14, which are arranged in laterally spaced relationship, for spraying the dampening fluid onto the surface of the dampening roller 10. Each of the nozzles 14 has an individual spray pattern 16, which is generally oval in shape, with the longest dimension being along the axis of the dampening roller 10. The individual composite spray patterns 16 merge on the surface of the dampening roller 10 in a substantially continuous, laterally extending composite individual spray pattern. In order to obtain the best dampening, and thus the best printing, it is highly desirable to have the composite spray pattern uniform throughout its width, so that no portion of the dampening roller 10 will be either under-dampened or over-dampened. In order to accomplish this, it is preferred that the individual spray patterns be precisely defined so that the ends of the adjacent individual spray patterns meet, but do not substantially overlap. An overlapping condition may cause overwetting in the overlapped portions of the dampening roller 10, and if the individual spray patterns 16 do not meet, there will be a starving between the spray patterns, either condition adversely affecting the dampening of the plate cylinder by the dampening roller 10 and thus the quality of the printing. Since the spray patterns of the nozzles diverge outwardly from the nozzles, the positioning of the nozzles with respect to one another, and with respect to the dampening roller 10, is very important.

In some printing operations, however, it is desirable to dampen only a portion of the dampening roller 10, so that printing can occur on, for example, a 50-inch wide strip of paper, rather than a 60-inch wide strip. Prior to this invention there was really no way in which it was possible to achieve this adjustment in the width of the dampening other than to turn off the end nozzles. However, this usually does not result in a proper width adjustment. For example, for a composite spray pattern of 60 inches wide, eight spray nozzles 14 may be employed, each nozzle spraying a pattern 7.5 inches in width. These patterns meet to form a 60-inch wide composite spray pattern. If it is desired to reduce the spray pattern to 50 inches, this could not be accomplished by merely turning off the end nozzles, since this would result in a 15-inch reduction to a 45 inch composite pattern rather than a 10-inch reduction to a 50 inch composite pattern. Thus, the composite spray pattern would not be wide enough to cover the full 50 inches. In other words, precise adjustments in the width of the composite spray pattern has not been heretofore possible.

Figure 2:
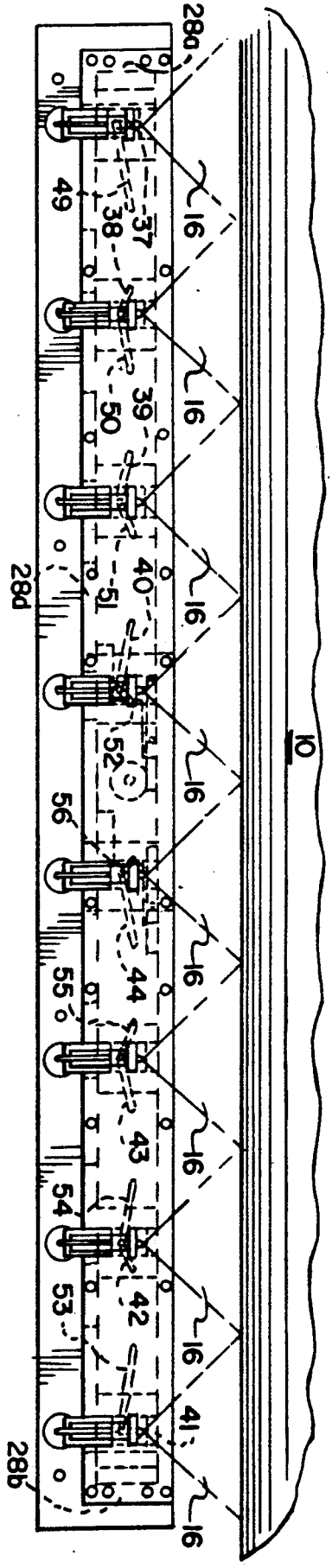
FIG. 2 is a front elevational view of the adjustable spray dampening system in one of two extreme position of adjustment with the spray nozzles most widely spread apart and retracted rearwardly away from the surface of the dampening roller.
Figure 3:
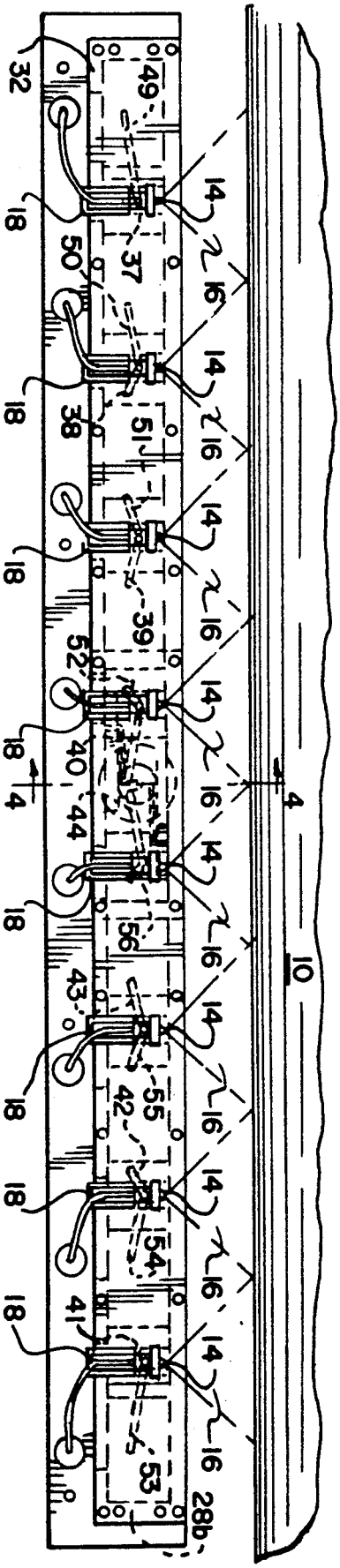
FIG. 3 is a front elevational view of the spray dampening system in the other extreme position of adjustment with the nozzles positioned closest together and extended forwardly toward the surface of the spray dampening roller.

It is also not possible to achieve this precise adjustment merely by moving the nozzles closer together in order to achieve the 50-inch wide composite pattern, because the adjacent spray patterns would thus overlap, and cause overwetting in the overlapped areas. In accordance with the present invention, means is provided for adjustably moving the spray nozzles laterally toward and away from each other, while at the same time, moving them axially toward and away from the dampening surface, so that the width of the composite spray pattern may be adjusted while preventing excessive overlapping of the laterally adjacent individual spray patterns. In FIG. 2, the nozzles are shown in their widest, most spread-apart position, spraying their spray patterns 16 to form the composite spray pattern on the surface of the dampening roller 10 in a 60" width. In FIG. 3, the nozzles are shown laterally moved together, and simultaneously moved axially toward the dampening surface of the roller 10, to achieve a 50" wide composite pattern.

In order to achieve this movement of the nozzles, each nozzle 14 is mounted on a substantially U-shaped nozzle carriage 18. It is these nozzle carriages 18 which are moved toward and away from each other, and toward and away from the dampening surface of the dampening roller 10. The dampening fluid manifold 20 is connected to a main plate 22, and flexible tubes 24 convey the dampening fluid from the manifold 22 to the nozzles 14.

Figure 5:
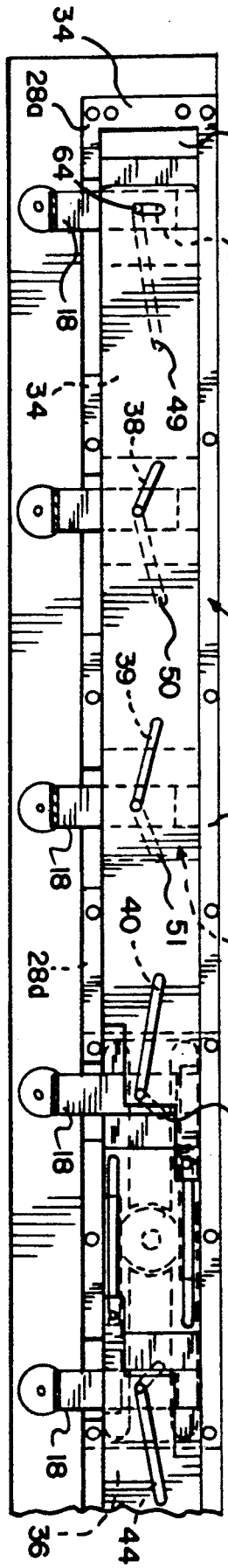
FIG. 5 is a slightly enlarged front elevational view of the left side of the adjustable spray dampening system with portions of the system removed to show the cam members and carriage followers in their widest, most spread-apart position of adjustment.
Figure 6:
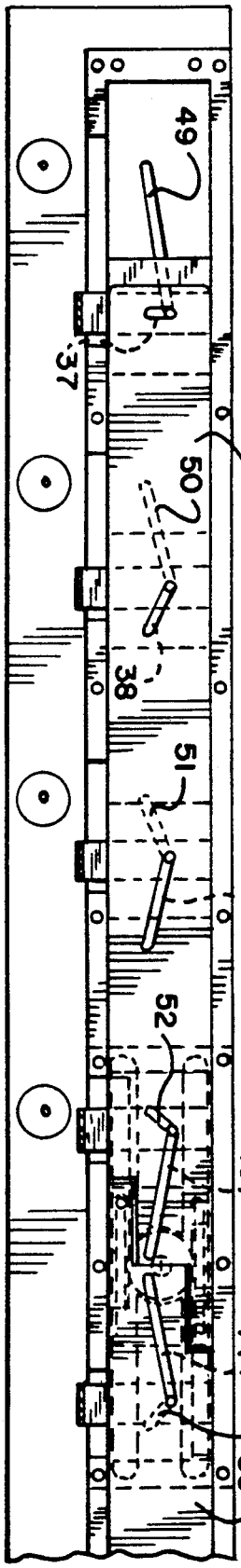
FIG. 6 is a similar slightly enlarged front elevational view of the system showing the cam members and followers moved to their narrowest position of adjustment, taken substantially along line 6—6 of FIG. 4.

Affixed to the mainplate 22 by suitable fastener means 26 is a spacer member 28, a stationary plate 30 and a cover plate 32. As may be seen in dotted lines in FIGS. 2 and 3 and in solid lines in FIGS. 4, 5 and 6, the spacer member 28 has end portions 28*a* and 28*b* (see FIGS. 2 and 3) a top track portion 28*c*, and a bottom spacer portion 28*d*, leaving a rectangular central opening, 28*e*, in the middle. Mounted within the central opening 28*e* of the spacer member, for sliding movement toward and away from each other along the two spacer member track portions 28*c* and 28*d*, are two movable cam members 34 and 36. The left hand cam member 34 has cam slots 37, 38, 39 and 40, and the right hand cam member 36 has corresponding mirror image cam slots 41, 42, 43 and 44, best seen in FIGS. 2 and 3.

The stationary plate 30 extends over the hollow central area 28*e* of the spacer member, and completely covers the two movable cam members 34 and 36. This stationary plate 30 has guide slots therein which correspond in number to the cam slots 37–44 of the movable cam members 34 and 36. Thus, the stationary plate 30 has guide slots 49, 50, 51 and 52 on the left side, and identically constructed mirror image guide slots 53, 54, 55 and 56 on the right side. These are best shown in FIGS. 2, 3, 5 and 6.

Figure 4:
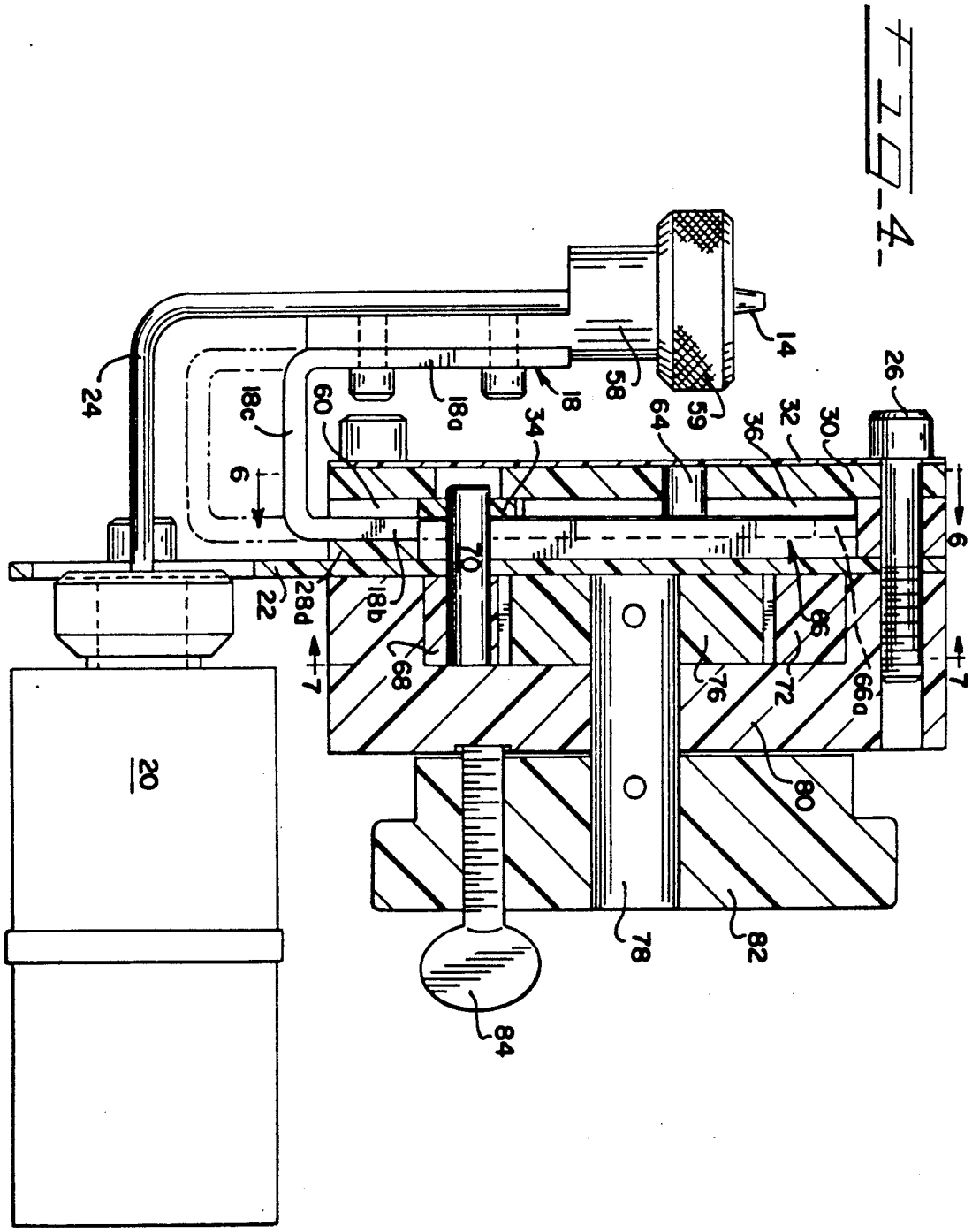
FIG. 4 is a cross-sectional elevational view of the adjustable spray dampening system taken substantially along line 4—4 of FIG. 3 and showing the means for moving the spray nozzles and nozzle carriages through their various positions of adjustment.

As may be seen from FIG. 4, each of the nozzle carriages 18 is substantially U-shaped and has an upstanding outer leg 18*a*, an upstanding inner leg 18*b*, and a transverse bottom portion 18*c*. Bolted to the upstanding outer leg 18*a* of the nozzle carriage is a nozzle stem 58, on which the associated nozzle 14 is mounted, the nozzle being held in place by means of a nozzle nut 59. The upstanding inner leg 18*b* of each nozzle carriage 18 extends upwardly through a slot 60 in the bottom portion 28*d* of the spacer member 28. Thus, the inner leg 18*b* extends into the central space 28*e* of the spacer member, behind the corresponding movable cam member 34 or 36, as the case may be.

Attached to the upper end of each nozzle carriage upstanding inner leg 18*b*, is a follower 64. Each follower extends through a corresponding cam slot in the movable cam member 36, and a corresponding guide slot in the stationary plate 30. Thus, for example, the follower 64 of the nozzle carriage 18 at the right hand end of the spray dampening system extends through the cam slot 37 in the movable cam member 36, and through the guide slot 49 of the stationary plate 30. It may thus be seen that movement of the left hand cam member 34 to the right, and movement of the right hand cam member 36 to the left, will cause the cam slots 37–44 in these two movable cam members to move the followers 64 of the 8 nozzle carriages upwardly in the guide slots 49–56 of the stationary plate.

The cam slots 37–40 of the movable cam member 34 are mirror images of the cam slots 41–44 of the movable cam member 36. In like manner, the guide slots 49–52 of the stationary plate 30 are mirror images of the guide slots 53–56 of that member. When the followers 64 are at the lower end of the stationary plate guide slots 49–56, the followers 64, and thus the nozzle carriages 18 and the nozzles 14, will be in their most spread-apart position, furthest from the surface of the dampening roller 10. When the movable cam members 34 and 36 are moved toward each other they will cause the followers 64 to move along the stationary plate guide slots 49–56 toward each other and upwardly toward the surface of the dampening roller 10, carrying with them the nozzles 14. Thus, the guide slots 49–56 determine the position of the followers 64 at any one position of adjustment and determine the path which the followers will take in moving from one extreme position of adjustment to another.

In the movement of the nozzles 14 close together, it is apparent that the two innermost nozzles in the system must have the least lateral motion, and the two outer nozzles must have the most lateral motion, because all of the other nozzles are moving away from the outer nozzles. In order to accomplish this with the same movement of the movable cam members 34 and 36, the cam slots 37–44 are actually formed as part of a "lost motion" connection between the movable cam members 34 and 36 and the various followers 64. This may be readily seen in FIGS. 5 and 6, where there is no lost motion connection for the outermost nozzle carriage follower, and the cam slot 37 is vertical. For the next nozzle inwardly to the right, however, the movement of the follower 64 will be less, and thus the guide slot 50 in the stationary plate 46 is not as long as the guide slot 49. The difference between the lateral movement of the cam member 34 and the lateral dimension of the guide slot 50 is made up by the angular disposition (i.e., lateral dimension) of the cam slot 38 to provide the needed amount of lost motion connection. The guide slot 51 of the stationary 30 is even shorter, and the cam slot 39 provides an even greater lost motion connection by virtue of its increased length (lateral dimension). Of course, the sum of the lateral dimensions of each cam slot and the associated guide slot remains the same, because the movable cam members 34 and 36 must move laterally a sufficient distance to move the followers 64 along the entire length of the end guide slots 49 and 53 for the two end nozzles. By the same token, the vertical height of the cam slots and guide slots are the same, because each of the followers 64 must be moved vertically the same distance toward and away from the surface of the dampening roll 10.

With this "lost motion" connection achieved through angular disposition of the cam slots 37–44, and with the length and orientation of the guide slots 49–56 determined by the end positions required for the followers 64 at their extreme positions of adjustment, the followers will always be in lateral alignment, the proper distance from the surface of the dampening roller, and the proper distance apart in every position of adjustment between the two extreme positions.

The carriages 18 in the vertical movement must always remain in proper vertical orientation, that is to say, the lateral and vertical movement of the carriages must not affect the vertical orientation of the carriages and the nozzles 14 carried thereon. In order to assure the vertical orientation of the carriages, a plurality o stabilizer members 66 are provided, one for each carriage 18. The stabilizer members 66 are in the form of plates each having a vertical guideway or track 66*a* formed therein for accomodating the vertical sliding movement of the associated carriage 18. The stabilizer members 66 are mounted for sliding horizontal movement within the open central portion 28*e* of the spacer member, between the top track portion 28*c* and the bottom track portion 28*d* of that member. Thus, as the followers 64 attached to the nozzles carriages 18 are moved laterally and vertically throughout their various positions of adjustment along the horizontal track formed by the spacer member track portions 28*c* and 28*d*, the carriages 18 will be maintained in vertical orientation by means of the stabilizer members 66, which move laterally with the carriages 18 but are prevented from any vertical or twisting movement. Alternatively, various other horizontal track arrangements for the stabilizing members 66 may be utilized and various other well known vertical track arrangements for the carriages 18 may be utilized.

Figure 7:
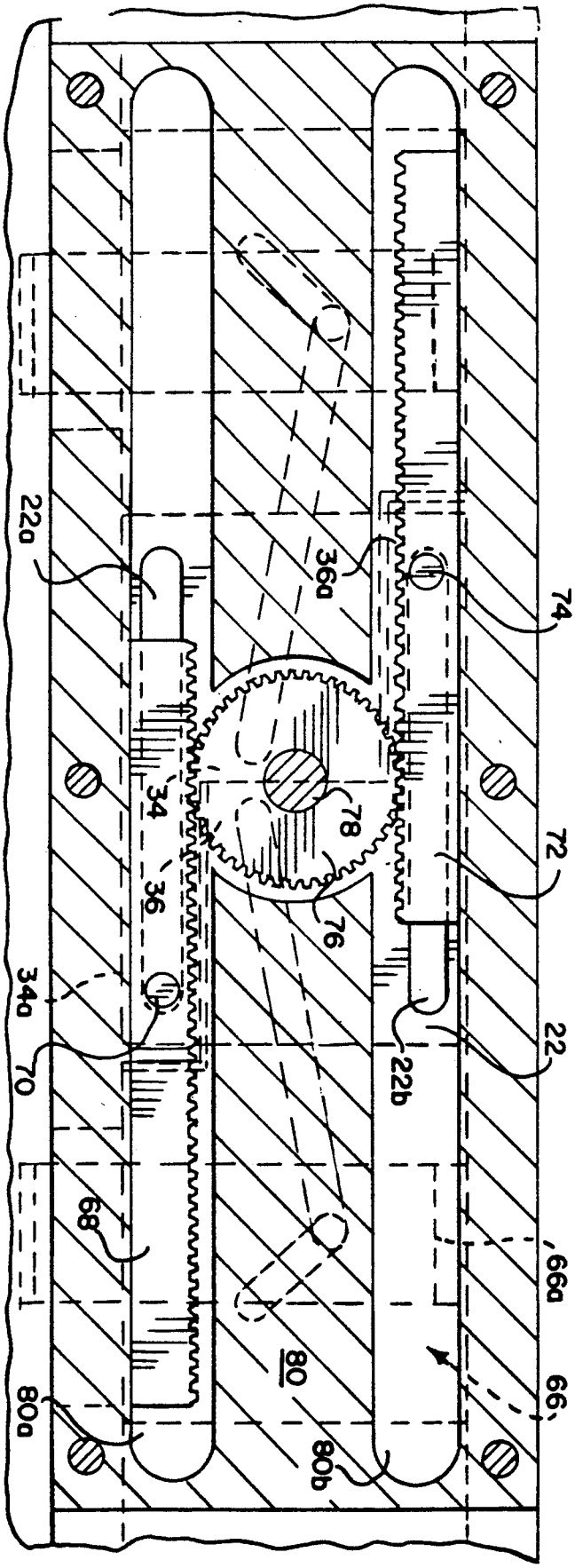
FIG. 7 is a rear elevational view of a portion of the system showing the rack and pinion drive for moving the movable cam members through their various positions of adjustment relative to one another.

Means is provided for moving the movable cam members 34 and 36 toward and away from each other in a horizontal direction. In the illustrated embodiment, this is accomplished by means of a rack and pinion arrangement best seen in FIG. 7. In that figure, which is a view from the rear of the system illustrated in the other figures, a rack 68 is attached to a leg 34*a* of the movable cam member 34 by means of a dowel 70. This can also be seen in FIG. 4. In like manner, a rack 72 is attached to a leg 36*a* of the movable cam member 36 by means of a dowel 74. In meshing engagement with the racks 68 and 72 is a pinion gear 76 affixed to a shaft 78, which is journalled in a gear and rack box 80 attached to the main plate 22 (see FIG. 4). The shaft 78 extends outwardly through the rear side of the gear and rack box 80, and on this outwardly extending end of the shaft there is affixed an adjustment knob 82. A thumbscrew 84 extends through the adjustment knob to lock the adjustment knob into the desired position of rotational adjustment with respect to the gear and rack box 80.

The gear and rack box 80 has lower and upper slots 80*a* and 80*b* within which the racks 68 and 72 respectively are permitted to move. In like manner, the main plate 22 has horizontal slots 22*a* and 22*b* within which the dowels 70 and 74 are permitted to move throughout their positions of adjustment, carrying with them the movable cam members 34 and 36, respectively.

It will be readily apparent that means other than a rack and pinion gear arrangement can be utilized to move the movable cam members 34 and 36 toward and away from each other. For example, servo motors of well known construction could be used to move the two movable cam members 34 and 36 relative to one another. Alternatively, a worm gear could be used to affect this relative movement. In fact, it would be possible and within the scope of this invention to eleminate both the stationary plate 30 with its guide slots and the movable cam members 34 and 36 and substitute one or more worm gears with variable pitched portions in meshing engagement with separate racks, each attached to one of the nozzle carriages so that the carriages could be moved laterally relative to one another while they were moved as a unit toward and away from the surface of the dampening roller 10.

The cam and pinion gear arrangement with the adjustment knob 82 and thumbscrew 84 provides a very convenient and easy manual method for making these adjustments. When the thumbscrew 84 is tightened down on the gear and rack box 80 as illustrated in FIG. 4, the pinion gear 76 will be prevented from rotating, and thus the racks 68 and 72 will be prevented from moving. The movable cam members to which these racks are attached thus will be locked in the desired position of adjustment.

In operation, if it is desired to narrow the width of the composite spray pattern, consisting of the spray patterns 16 from the eight nozzles 14, the thumbscrew 84 is released and the adjustment knob 82 is turned to move the movable cam members 34 and 36 toward each other. The movable cam member 34 carrying cam slots 37–40 moves the followers 64 attached to the nozzles carriages 18 along the guide slots 49–52 of the stationary plate 30. In like manner, the movable cam member 36 carrying the cam slots 41–44 moves the followers 64 attached to the nozzle carriages 18 along the guide slots 53–56 of the stationary plate 30.

As the followers are moved laterally, they are also moved vertically toward the surface of the dampening roller 10, thus causing the individual spray patterns 16 at the surface of the dampening roller to be narrower. There will thus be no overlapping of the spray patterns, even though the spray nozzles are moved closer together, and thus a very uniform wetting of the surface of the dampening roller 10 is achieved.

The adjustment of the width of the composite spray pattern as described may be utilized in combination with nozzle shut off controls to obtain any width of composite spray patterns desired. For example, by shutting off one or two of the end nozzles, composite patterns of between about 45 inches and about 37.5 inches may be achieved. This provides a very precise and extremely flexible adjustment for the dampening pattern or patterns on the surface of the dampening roller 10.

The foregoing description has been given by way of example, and it will be readily apparent to those skilled in the art that various modifications can be made in the structure of the spray dampening system without departing from the spirit and scope of the invention as hereinafter claimed.

What is claimed is:

1. In a spray dampening system, a plurality of spray nozzles arranged in laterally spaced relationship for spraying dampening fluid onto a dampening surface of a printing press in laterally adjacent individual spray patterns which merge on the dampening surface in a substantially continuous and laterally extending composite spray pattern, means for adjustably moving said spray nozzles simultaneously laterally toward and away from each other and for adjustably moving said spray nozzles together as a unit axially toward and away from the dampening surface, whereby the width of the composite spray patten may be adjusted while preventing excessive overlapping of the laterally adjacent individual spray patterns.

2. The structure of claim 1 wherein means is provided for maintaining said spray nozzles in axial parallel relationship throughout all positions of adjustment.

3. The structure of claim 1 wherein said means for adjustably moving said spray nozzles is operable to maintain said spray nozzles transversely aligned throughout all positions of adjustment.

4. The structure of claim 1 wherein said means for adjustably moving said spray nozzles is operable to maintain said spray nozzles uniformly spaced apart throughout all positions of adjustment.

5. The structure of claim 1 wherein said means for adjustably moving said spray nozzles is operable to move said nozzles simultaneously toward said dampening surface as said nozzles are moved toward each other and simultaneously away from said dampening surface as said nozzles are moved away from each other.

6. The structure of claim 1 wherein said means for adjustably moving said spray nozzles comprises a plurality of movable nozzle carriages, one for each nozzle, each carriage having a follower, a stationary member having a plurality of guideways, each for guiding one of the carriage followers along a pathway between a first position of adjustment closest to the dampening surface and a second position of adjustment farthest from the dampening surface, and drive means for engaging said carriage followers and forceably moving said followers along the respective stationary member guideways between said first and second positions.

7. The structure of claim 6 wherein said drive means engages and moves said carriage followers simultaneously between said first and second positions.

8. The structure of claim 7 wherein said drive means is operable to maintain said carriage followers in transverse linear alignment throughout all positions of adjustment.

9. The structure of claim 8 wherein said drive means includes at least one cam member mounted for reciprocating movement relative to said stationary member.

10. The structure of claim 9 wherein said drive means includes a pair of cam members mounted for reciprocating movement relative to said stationary member and relative to each other, and means for moving said cam members outwardly away from each other and inwardly toward each other.

11. The structure of claim 10 wherein said cam members have cam slots therein, each for accomodating a carriage follower and for moving said follower along the associated guideway of said stationary member as said cam members are moved relative to said stationary member.

12. The structure of claim 10 wherein the guideways of said stationary member are slots in said stationary member, each for accommodating a nozzle carriage follower, whereby as said cam members are reciprocated, said carriage followers will be forced to move from one end of the slots in said stationary and cam members to the other end of said slots.

13. The structure of claim 10 and further including carriage guide means for maintaining said nozzle carriages in axial parallel relationship throughout all positions of adjustment.

14. The structure of claim 13 wherein said carriage guide means includes a horizontal track, a stabilizer member for each carriage mounted for movement only along said horizontal track, each guide member having vertical track portions interfitting with vertical portions of said carriage for permitting only vertical movement of the carriage relative to said stabilizer member, whereby each said carriage may move only vertically along the associated stabilizer member vertical track portions, and the associated stabilizer member may move only horizontally along said horizontal track.

15. The structure of claim 10 wherein each of said cam members includes a rack formation and said means for moving said cam members relative to each other includes a pinion in engagement with the rack formations of said cam members, and means is provided for rotating said pinion to effect reciprocal movement of said rack formations and said cam members toward and away from each other.

16. In a spray dampening system, a plurality of spray nozzles arranged in laterally spaced relationship for spraying dampening fluid onto a dampening surface of a printing press in laterally adjacent individual spray patterns which merge on the dampening surface in a substantially continuous and laterally extending composite spray pattern; a plurality of nozzle carriages, one for each nozzle, each carriage having a follower; a stationary member having a plurality of guideway slots, each for accommodating a nozzle carriage follower and for guiding said follower along a pathway between a first position of adjustment closest to the dampening surface and a second position of adjustment farthest away from the dampening surface; a pair of cam members mounted for reciprocating movement relative to said stationary member and relative to each other, said cam members having cam slots therein, each for accommodating a carriage follower, and means for moving said cam members relative to said stationary member outwardly away from each other and inwardly toward each other to effect movement of the associated carriage followers along the associated guideway slots of said stationary member.

17. The structure of claim 16 and further including means for maintaining said nozzle carriages in axially parallel relationship as they are being moved through their various positions of adjustment.

18. The structure of claim 16 wherein said stationary member guideway slots are each angularly oriented with respect to each other such that as the carriages and their associated followers are moved through their various positions of adjustment, they will remain uniformly spaced apart as they are moved in one direction lateraly toward each other and axially toward the dampening surface and in the oposite direction away from each other and away from the dampening surface.

* * * * *